US006010352A

United States Patent [19]

Kameyama

[11] Patent Number: 6,010,352

[45] Date of Patent: Jan. 4, 2000

[54] CONNECTOR

[75] Inventor: Isao Kameyama, Shizuoka, Japan

[73] Assignee: Yazaki Corporation, Tokyo, Japan

[21] Appl. No.: 09/014,044

[22] Filed: Jan. 27, 1998

[30] Foreign Application Priority Data

Feb. 7, 1997 [JP] Japan ..... 9-024758

[51] Int. Cl.[7] ..... H01R 13/627

[52] U.S. Cl. ..... 439/350; 439/357; 439/603

[58] Field of Search ..... 439/350–357, 439/603, 586

[56] References Cited

U.S. PATENT DOCUMENTS 3,951,514 4/1976 Medina, Jr. ..... 439/357 X
4,161,776 7/1979 Onoue ..... 439/350 X

FOREIGN PATENT DOCUMENTS 2-11742 3/1990 Japan ..... H01R 13/639
2-11743 3/1990 Japan ..... H01R 13/639

*Primary Examiner*—Khiem Nguyen
*Attorney, Agent, or Firm*—Sughrue, Mion, Zinn, Macpeak & Seas, PLLC

[57] ABSTRACT

A connector includes a jack and an attachment plug which inserts into a socket of the jack. The plug has a plug body with an attachment pin planted at its forward end and sinkable lock portions projecting from an outer circumferential surface of the plug body so that the sinkable lock portions return to their initial positions automatically by their own elastic force. The jack has an engagement portion formed along the inner circumference of the plug insertion inlet of the socket so that the engagement portion locks the lock portions when the attachment plug is inserted into the jack. The engagement portion is formed by folding an end portion of the socket at the plug insertion inlet.

6 Claims, 4 Drawing Sheets

CONNECTOR

BACKGROUND OF THE INVENTION

1. Field of the Invention

This invention relates to a connector including an attachment plug and a jack, and particularly relates to an improvement of such a connector for use in a wiring cable for connecting a mobile antenna and a transmitter-receiver with each other.

2. Background

FIGS. 3 and 4 show an example of a conventional technique disclosed in Japanese Utility Model No. Hei. 2-11743. The illustrated connector A is used in a wiring cable for connecting a mobile antenna and a transmitter-receiver. The connector A includes an attachment plug Al and a jack A2.

The attachment plug Al has a plug body b with an attachment pin A planted in its forward end. A spring piece c is mounted in the plug body b. The spring piece c can press against the inner circumferential surface of a hollow cylindrical socket t of the jack A2. Lock portions d and lock release portions e are projecting from an outer circumferential surface b1 of the plug body b. The lock portions d are sinkable but can return to their initial positions automatically by their own elastic force after they are sunk. The lock release portions e are also sinkable but can return to their initial positions automatically by their own elastic force. Furthermore, the lock release portions e are designated so as to compel the lock portions d to sink.

The jack A2 has the hollow cylindrical socket f into which the plug body b of the attachment plug A1 is to be inserted. The socket f has an outer cylinder f1 and a metal sleeve f2 closely contacting with the inner circumferential surface of the outer cylinder f1. An engagement portion h is formed on the socket f all over its inner circumference at a plug insertion inlet g through which the attachment plug A1 is to be inserted, so that the engagement portion h locks the lock portions d of the attachment plug A1 in the socket f through elastic displacement of the lock portions d when the attachment plug A1 is attached into the Jack A2.

In FIGS. 3 and 4, the reference symbol m designates a wiring cable attached to the attachment plug A1, and n designates a wiring cable attached to the jack A2.

In the connector A, an inner circumferential surface i of the engagement portion h of the socket f of the jack A2 is a slope so that the inner diameter of the engagement portion h is reduced gradually from a deeper portion of the socket f to the plug insertion inlet g. As is clearly shown in FIG. 4, after the attachment plug A1 has been attached into the jack A2, the top ends of the sinkable lock portions d of the attachment plug A1 abut against the inner circumferential surface i which is a slope, and the lock portions d of the attachment plug A1 is locked by the engagement portion h of the socket f of the jack A2.

However, in the connector A, when at least one of the attachment plug A1 and the jack A2 is pulled after the attachment plug A1 has been attached into the jack A2, lock reaction force acts on the sinkable lock portions d of the attachment plug A1 in the direction to cause elastic displacement of the lock portions d. Therefore, there is a possibility such that the lock portions d are sunk gradually along the inner circumferential surface i of the engagement portion h of the jack A2.

Accordingly, in the conventional connector A, there was a problem that even if the attachment plug A1 and the jack A2 were connected firmly, the connection between the attachment plug A1 and the jack A2 might be released when at least one of the attachment plug A1 and the jack A2 was pulled.

SUMMARY OF THE INVENTION

An object of the present invention is therefore to solve the foregoing problem.

Another object of the present invention is to provide a connector in which once an attachment plug and a jack are connected firmly, the connection between the attachment plug and the jack is not released even if at least one of the attachment plug and the jack is pulled.

The above objects have been achieved by a connector according to a first aspect of the present invention, the connector comprises an attachment plug and a jack; the attachment plug including a plug body having an attachment pin planted at its forward end, and sinkable lock portions projected from an outer circumferential surface of the plug body so that the sinkable lock portions return to their initial positions automatically by their own elastic force after they are sunk once; and the jack including a hollow cylindrical socket into which the plug body of the attachment plug is to be inserted, and an engagement portion formed all over an inner circumference of a plug insertion inlet of the socket through which the attachment plug is to be inserted so that the engagement portion locks the lock portions in the socket through elastic displacement of the lock portions when the attachment plug is inserted into the jack, the engagement portion being formed by folding an end portion of the socket at its plug insertion inlet side back into the socket.

Furthermore, the engagement portion is formed so as to make locking of the lock portions on the engagement portion act in a direction so that reaction force of the locking does not cause the elastic displacement of the lock portions.

According to the first aspect of the present invention, therefore, when the attachment plug is inserted through the plug insertion inlet of the socket of the jack so as to be attached into the jack, the sinkable lock portions of the attachment plug are once sunk at the time of passing through the engagement portion of the socket of the jack, and then elastically snapped to return to their initial positions immediately after they pass the engagement portion. Thus, the lock portions are locked by the engagement portion.

At this time, in the connector according to the first aspect of the present invention, the locking of the lock portions by means of the engagement portion is made to act in the direction such that the reaction force of the locking does not cause the elastic displacement of the lock portions. Accordingly, even if at least one of the attachment plug and the jack is pulled after the attachment plug has been attached into the jack, the reaction force of the locking acts on the sinkable lock portions of the attachment plug only in the direction not to cause the elastic displacement of the lock portions so that there is no possibility that the lock portions is made to sink.

Accordingly, in the connector of the first aspect of the present invention, once the attachment plug and the jack are connected firmly, the connection between the attachment plug and the jack is not released even if at least one of the attachment plug and the jack is pulled.

In addition, in the connector of the first aspect of the present invention, the engagement portion of the socket is formed by folding the end portion on the plug insertion inlet side of the socket back into the socket. It is therefore possible to form the engagement portion by post-working.

Accordingly, according to the first aspect of the present invention, by forming the engagement portion in an old-type socket having no engagement portion, the old-type socket can be revived.

According to a second aspect of the present invention, in the connector defined in the first aspect, rear end surfaces of the lock portions of the attachment plug are made perpendicular to an axial direction of the attachment plug so that the perpendicular rear end surfaces abut against a folded end portion of the engagement portion of the socket of the jack which is folded back deeper into the socket, so that the lock portions are locked by the engagement portion.

Accordingly, in the connector of the second aspect of the present invention, when the attachment plug is attached into the jack, the axially perpendicular rear end surfaces of the sinkable lock portions of the attachment plug abut against the deeper end portion of the engagement portion of the jack so that the sinkable lock portions are locked by the engagement portion.

Accordingly, in the connector of the second aspect of the present invention, even if at least one of the attachment plug and the jack is pulled after the attachment plug has been attached into the jack, the reaction force of the locking only in the direction parallel to the axial direction of the attachment plug acts on the rear end surfaces of the lock portions of the attachment plug through the folded end portion of the engagement portion of the socket of the jack. That is, the reaction force of the locking acts only in the direction not to cause elastic displacement of the lock portions, so that there is no possibility that the sinkable lock portions of the attachment plug are sunk.

Accordingly, also in the connector of the second aspect of the present invention, similarly to the connector of the first aspect, once the attachment plug and the jack have been connected firmly, the connection between the attachment plug and the jack is not released even if at least one of the attachment plug and the jack is pulled.

According to a third aspect of the present invention, in the connector defined in the second aspect, the rear end surfaces of the lock portions of the attachment plug abut against an end surface of the folded end portion of the engagement portion of the socket of the jack so that the lock portions are locked by the engagement portion.

Accordingly, in the connector of the third aspect of the present invention, it is possible to more increase the area where the rear end surfaces of the lock portions of the attachment plug abut against the engagement portion of the socket of the jack, in comparison with that of the second aspect of the present invention.

In the connector of the third aspect of the present invention, it is therefore possible to increase the engagement force with which the engagement portion of the socket locks the lock portions of the attachment plug, in comparison with that of the second aspect of the present invention.

According to a fourth aspect of the present invention, in the connector defined in any one of the first to third aspects, the inner circumferential surface of the engagement portion of the socket of the jack is made to be a slope having a diameter which is reduced gradually from the plug insertion inlet of the socket foward a deeper portion thereof.

Accordingly, in the connector of the fourth aspect of the present invention, when the attachment plug is inserted and attached into the jack through the plug insertion inlet of the socket of the jack, the sinkable lock portions of the attachment plug are sunk gradually along the inner circumferential surface of the engagement portion of the socket of the jack, and snapped to return to their initial positions when the lock portions have passed the inner circumferential surface of the engagement portion. Then, the lock portions of the attachment plug are locked by the engagement portion.

It is therefore possible in the connector of the fourth aspect of the present invention to attach the attachment plug into the jack smoothly.

According to a fifth aspect of the present invention, in the connector defined in any one of the first to fourth aspects, a spring member is provided in the plug body of the attachment plug so that the spring member presses against the inner circumferential surface of the engagement portion of the socket of the jack.

Accordingly, in the connector of the fifth aspect of the present invention, when the attachment plug is attached into the jack so that the lock portions of the attachment plug is locked by the engagement portion of the socket of the jack, the spring pieces attached to the plug body of the attachment plug press against the inner circumferential surface of the engagement portion of the socket of the jack to thereby prevent the plug body of the attachment plug from rattling in the socket of the jack.

Therefore, in the connector of the fifth aspect of the present invention, the connection between the jack and the attachment plug is made stable.

DETAILED DESCRIPTION OF THE PREFERRED EMBODIMENTS

First Embodiment

Figure 1:
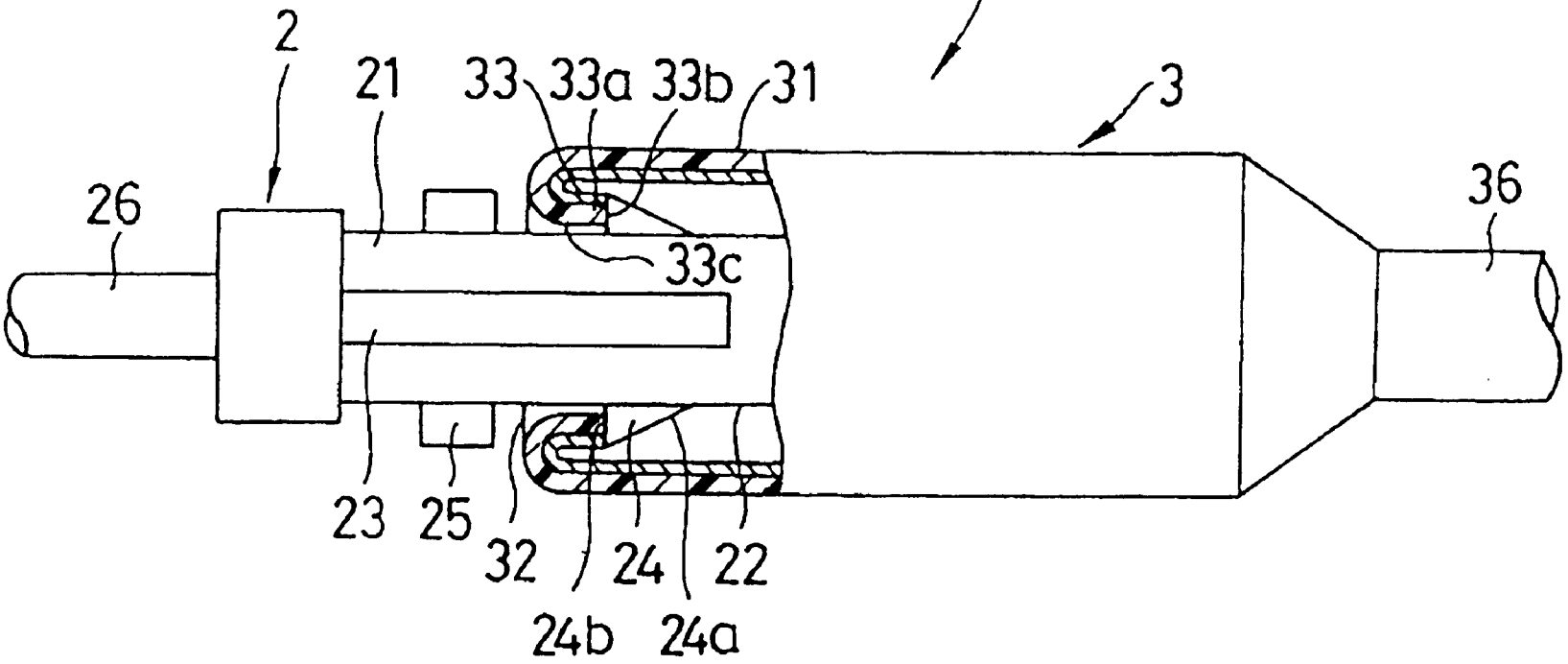
FIG. 1 is a partially broken front view illustrating a first embodiment of the present invention.

FIG. 1 shows a first embodiment to which the above-mentioned first, second, third and fifth aspects of the present invention are applied collectively. A connector 1 is used in a wiring cable for connecting a mobile antenna and a transmitter-receiver, and includes an attachment plug 2 and a jack 3.

The attachment plug 2 has a plug body 21 which has an attachment pin (not-shown) planted in its forward end. Two spring pieces 23 are mounted in the plug body 21. The spring pieces 23 can press against an inner circumferential surface 33*c* of an engagement portion 33 of a socket 31 of the jack 3.

Two sinkable lock portions 24 and two sinkable lock release portions 25 are projected from an outer circumferential surface 22 of the plug body 21. The sinkable lock portions 24 can return to their initial positions automatically by their own elastic force after they are once sunk, and the two sinkable lock release portions 25 are designed so as to compel the lock portions 24 to sink and can return to their initial positions automatically by their own elastic force. These lock release portions 25 are disposed behind the lock portions 24 so that they are positioned outside the socket 31 of the jack 3 after the attachment plug 2 has been attached into the jack 3.

Each of the lock portions 24 has a front end surface 24*a* formed into a slope which gradually separates away from the outer circumferential surface 22 of the plug body 21 from the forward end of the attachment plug 2 toward its rear end. A rear end surface 24*b* of each lock portion 24 is made perpendicular to the axial direction of the attachment plug 2.

The jack 3 has a hollow cylindrical socket 31 into which the plug body 21 of the attachment plug 2 is to be inserted. The outside portion of the socket 31 is formed from thermoplastic resin while the inside portion of the same is formed from metal. The whole circumference of the end portion of the socket 31 on a plug insertion inlet 32 side through which the attachment plug 2 is to be inserted is folded back into the socket 31 with a bending angle of 180 degrees. That is, an engagement portion 33 is formed all over the inner circumference on the plug insertion inlet 32 side so that the engagement portion 33 locks the lock portions 24 of the attachment plug 2 in the socket 31 through elastic displacement of the lock portions 24 when the attachment plug 2 is attached into the jack 3.

An end surface 33*b* of a folded end portion 33*a* of the engagement portion 33 extending deeply into the socket 31 is made perpendicular to the axial direction of the socket 31. The rear end surfaces 24*b* of the respective lock portions 24 of the attachment plug 2 abut against the perpendicular end surface 33*b,* so that the lock portions 24 are locked by the engagement portion 33 after the attachment plug 2 has been inserted into the jack 3.

In FIG. 1, the reference numerals 26 and 36 designate wiring cables attached to the attachment plug 2 and the jack 3, respectively.

In the connector 1 described above, when the attachment plug 2 is attached and connected to the jack 3, the sinkable lock portions 24 of the attachment plug 2 are sunk gradually when they pass the engagement portion 33 of the socket 31 of the jack 3 and then snapped to return to their initial positions elastically immediately after they have passed the engagement portion 33 so that the axially perpendicular rear end surfaces 24*b* of the attachment plug 2 abut against the axially perpendicular end surface 33*b* of the folded end portion 33*a* of the jack 3, and the lock portions 24 are locked by the engagement portion 33 of the socket 31 of the jack 3.

In the connector 1, therefore, even if at least one of the attachment plug 2 and the jack 3 is pulled after the attachment plug 2 and the jack 3 have been connected to each other, the rear end surfaces 24*b* of the lock portions 24 of the attachment plug 2 are merely pushed in the axial direction of the attachment plug 2 through the end surface 33*b* of the folded end portion 33*a* of the engagement portion 33 of the socket 31 of the jack 3.

Accordingly, in the connector 1, the reaction force of the locking does not act in the direction to make the lock portions 24 sink perpendicularly to the axial direction of the attachment plug 2. Since the lock portions 24 are not sunk, there is no possibility that the connection between the attachment plug 2 and the jack 3 is released, even if at least one of the attachment plug 2 and the jack 3 is pulled after the attachment plug 2 and the jack 3 have been connected to each other.

In addition, in the connector 1, the rear end surfaces 24*b* of the lock portions 24 of the attachment portion 2 abut against the end surface 33*b* of the folded end portion 33*a* of the engagement portion 33 of the jack 3. Accordingly, the contact area where the rear end surfaces 24*b* of the lock portions 24 of the attachment plug 2 abut against the engagement portion 33 of the socket 31 of the jack 3 is larger than that of a connector 10 shown in FIG. 2 which will be described later. Accordingly, the maximum value of the locking force with which the engagement portion 33 of the jack 3 locks the lock portions 24 of the attachment plug 2 becomes large.

In addition, in the connector 1, when the attachment plug 2 is attached into the jack 3, the spring pieces 23 mounted on the plug body 21 of the attachment plug 2 press against the inner circumferential surface 33*c* of the engagement portion 33 of the socket 31 of the jack 3, so as to prevent the plug body 21 of the attachment plug 2 from rattling in the socket 31 of the jack 3. Therefore, the connection between the jack 3 and the attachment plug 2 is made stable.

Furthermore, in the connector 1, the attachment plug 2 has the lock release portions 25. Accordingly, it is possible to attach the attachment plug 2 into the jack 3, and further, it is possible to remove the attachment plug 2 from the jack 3.

Second Embodiment

Figure 2:
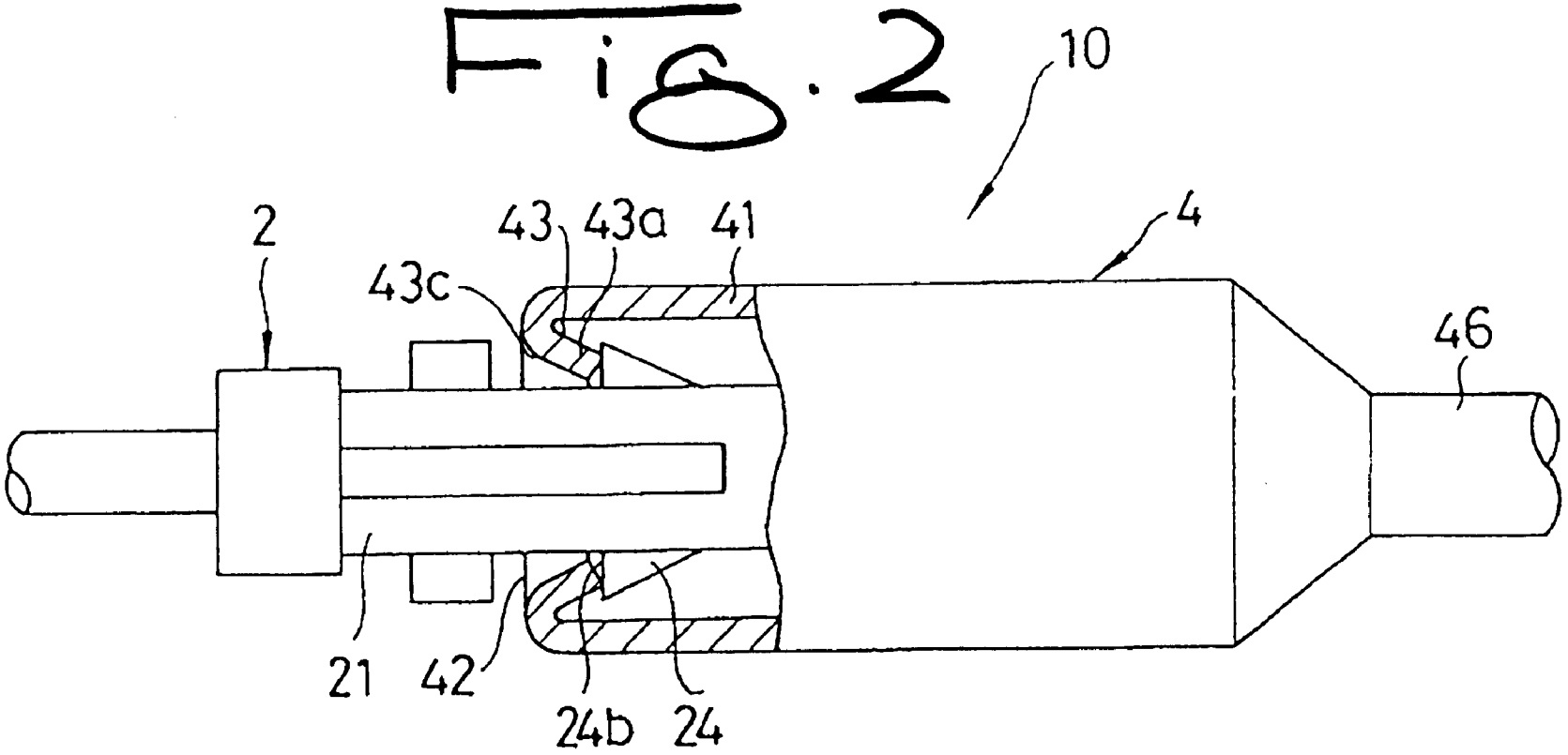
FIG. 2 is a partially broken front view illustrating a second embodiment of the present invention.
Figure 3:
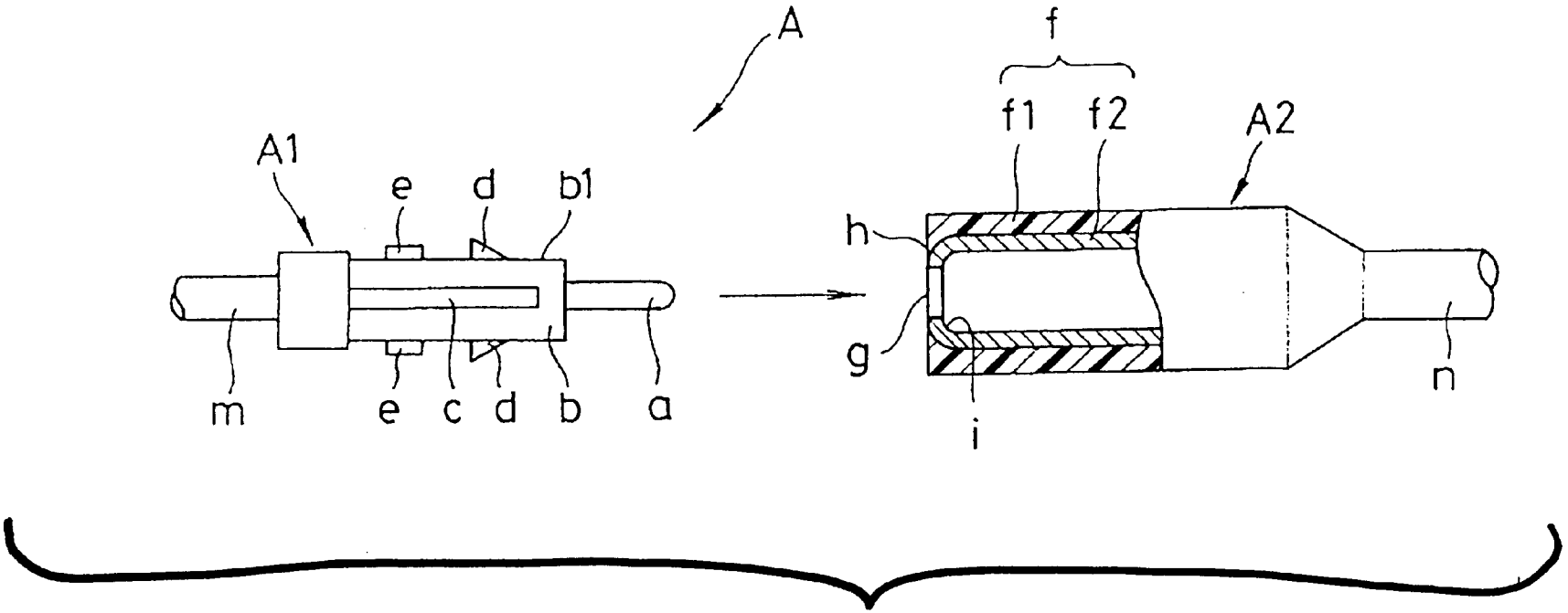
FIG. 3 PRIOR ART
FIG. 3 is a partially broken front view illustrating an example of a conventional connector.
Figure 4:
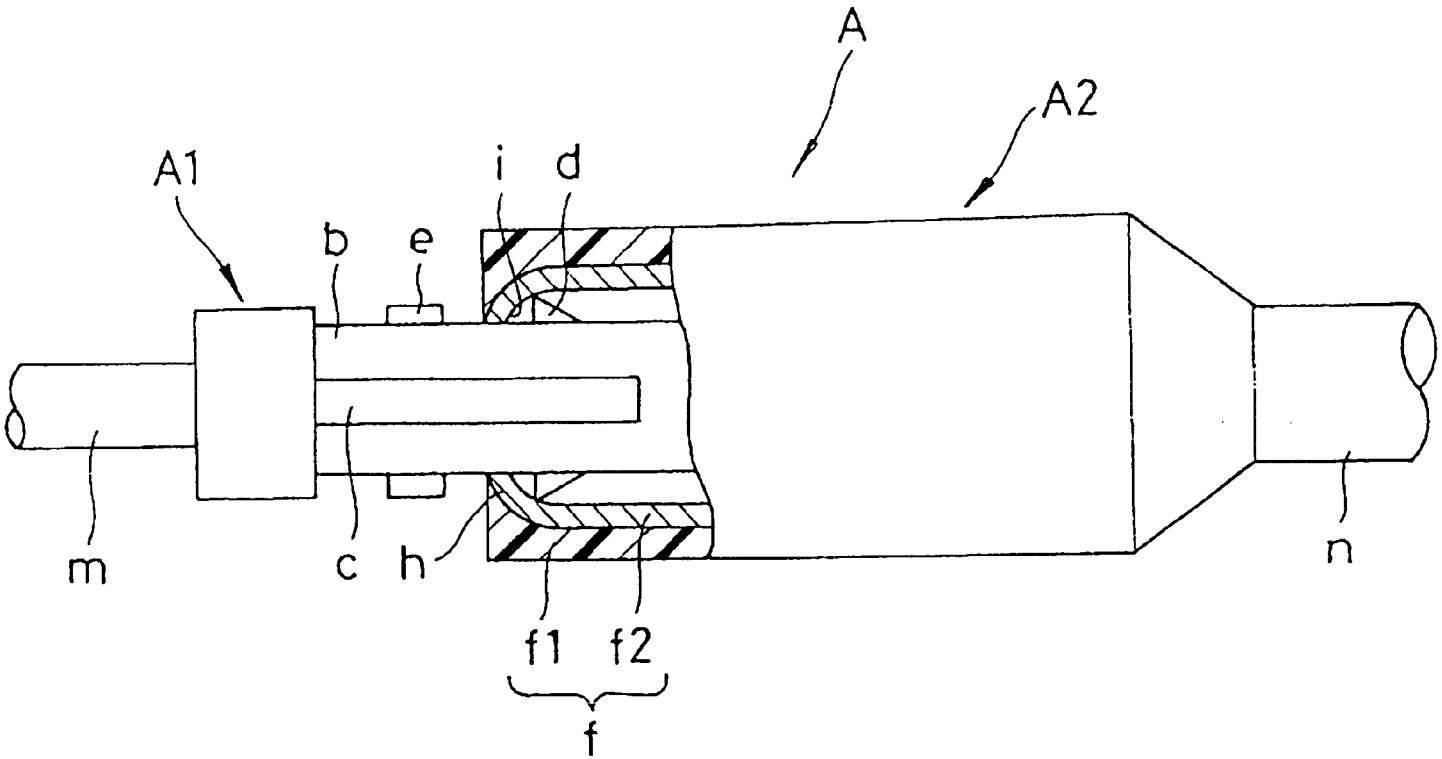
Fig. 4 PRIOR ART
FIG. 4 is a partially broken front view illustrating a connection state of the conventional connector shown in FIG. 3.

FIG. 2 shows a second embodiment in which the first, second, fourth and fifth aspects of the present invention are applied collectively. An attachment plug 2 of this connector 10 is the same as the attachment plug 2 of the connector 1 shown in FIG. 1 which has been described above. The attachment plug 2 is therefore referenced correspondingly, and its description will be omitted in the following description of the connector 10.

A jack 4 of the connector 10 has a hollow cylindrical socket 41 into which a plug body 21 of the attachment plug 2 is inserted. This socket 41 is formed from metal, and the whole circumference of the end portion on a plug insertion inlet 42 side through which the attachment plug 2 is to be inserted is folded into the socket 41 with a bending angle of about 150 degrees. An engagement portion 43 for locking lock portions 24 of the attachment plug 2 in the socket 41 through elastic displacement of the lock portions 24 is formed on the whole inner circumference of the plug insertion inlet 42.

Rear end surfaces 24*b* of the lock portions 24 of the attachment plug 2 abut against a folded end portion 43*a* of the engagement portion 43 which is folded back into the socket 41, so that the lock portions 24 are locked by the engagement portion 43. An inner circumferential surface 43*c* of the engagement portion 43 is formed into a slope the diameter of which is reduced gradually from the plug insertion inlet 42 of the socket 41 toward the deeper portion thereof.

In FIG. 2, the reference numeral 46 represents a wiring cable attached to the jack 4.

In the connector 10 described above, since the inner circumferential surface 43*c* of the engagement portion 43 is formed into a slope the diameter of which is reduced gradually from the plug insertion inlet 42 of the socket 41 toward the deeper portion thereof, the sinkable lock portions 24 of the attachment plug 2 are sunk gradually along the inner circumferential surface 43*c* of the engagement portion 43 of the socket 41 of the jack 4 when the attachment plug 2 is inserted into the plug insertion inlet 42 of the socket 41 of the jack 4 so as to be attached into the jack 4. When the sinkable lock portions 24 have passed the inner circumferential surface 43*c,* they are snapped to return to their initial positions, and locked by the engagement portion 43 of the socket 41 of the jack 4.

It is therefore possible to attach the attachment plug 2 into the jack 4 smoothly in the connector 10.

In addition, in the connector 10, even if at least one of the attachment plug 2 and the jack 4 is pulled after the attachment plug 2 has been attached into the jack 4, only the reaction force of the locking parallel to the axial direction of the attachment plug 2 acts on the rear end surfaces 24*b* of the lock portions 24 of the attachment plug 2 through the folded end portion 43*a* of the engagement portion 43 of the socket 41 of the jack 4 so that there is no possibility that the sinkable lock portions 24 of the attachment plug 2 are sunk.

Also in the connector 10, therefore, similarly to the connector 1, once the attachment plug 2 and the jack 4 are connected firmly, the connection between the attachment plug 2 and the jack 4 is not released even if at least one of the attachment plug 2 and the jack 4 is pulled.

Although description has been made about the case where the connector 1 or 10 is used in a wiring cable connecting a mobile antenna and a transmitter-receiver, the application of the present invention is not limited to this case but it is applicable also to any case so long as a connector includes an attachment plug and a jack.

In the connector according to the first aspect of the present invention, even if at least one of the attachment plug and the jack is pulled after the attachment plug has been attached into the jack, the reaction force of the locking acts on the sinkable lock portions of the attachment plug only in the direction not to cause the elastic displacement of the lock portions so that there is no possibility that the lock portions are made to sink. Accordingly, once the attachment plug and the jack are connected firmly, the connection between the attachment plug and the jack is not released even if at least one of the attachment plug and the jack is pulled.

In addition, in the first aspect of the present invention, the engagement portion of the socket can be formed in the socket by post-working. Accordingly, by forming an engagement portion in an old-type socket having no engagement portion, the old-type socket can be revived.

In the connector of the second aspect of the present invention, even if at least one of the attachment plug and the jack is pulled after the attachment plug has been attached into the jack, the reaction force of the locking only in the direction parallel to the axial direction of the attachment plug acts on the rear end surfaces of the lock portions of the attachment plug through the folded end portion of the engagement portion of the socket of the jack, so that there is no possibility that the sinkable lock portions of the attachment plug are sunk. Accordingly, similarly to the connector of the first aspect, once the attachment plug and the jack have been connected firmly, the connection between the attachment plug and the jack is not released even if at least one of the attachment plug and the jack is pulled.

In the connector of the third aspect of the present invention, it is possible to more increase the area where the rear end surfaces of the lock portions of the attachment plug abut against the engagement portion of the socket of the jack, in comparison with that of the second aspect of the present invention. It is therefore possible to increase the engagement force with which the engagement portion of the socket locks the lock portions of the attachment plug, in comparison with that of the second aspect of the present invention.

In the connector of the fourth aspect of the present invention, when the attachment plug is attached into the jack, the sinkable lock portions of the attachment plug are sunk gradually along the inner circumferential surface of the engagement portion of the socket of the jack, and snapped to return to their initial positions when the lock portions have passed the inner circumferential surface of the engagement portion. Then, the lock portions of the attachment plug are locked by the engagement portion of the socket of the jack. It is therefore possible to attach the attachment plug into the jack smoothly.

In the connector of the fifth aspect of the present invention, when the attachment plug is attached into the jack, the spring pieces attached to the plug body of the attachment plug press against the inner circumferential surface of the engagement portion of the socket of the jack to thereby prevent the plug body of the attachment plug from rattling in the socket of the jack. The connection between the jack and the attachment plug is therefore stable.

What is claimed is:

1. A connector, comprising:

an attachment plug including:

a plug body having an attachment pin planted at a forward end thereof, and sinkable lock portions projected from an outer circumferential surface of the plug body so that the sinkable lock portions return to their initial positions automatically by elastic force of the sinkable lock portions after the sinkable lock portions are sunk once; and a jack including:

a hollow cylindrical socket having a plug insertion inlet into which the plug body of the attachment plug is to be inserted, and an engagement portion formed all over an inner circumference of the plug insertion inlet of the socket through which the attachment plug is to be inserted so that the engagement portion locks the lock portions in the socket through elastic displacement of the lock portions when the attachment plug is inserted into the jack, the engagement portion being formed so that an end portion of the socket at the plug insertion inlet is folded back into the socket to form a U-shape.

2. A connector, comprising:

an attachment plug including:

a plug body having an attachment pin planted at a forward end thereof, and sinkable lock portions projected from an outer circumferential surface of the plug body so that the sinkable lock portions return to their initial positions automatically by elastic force of the sinkable lock portions after the sinkable lock portions are sunk once; and a jack including:

a hollow cylindrical socket having a plug insertion inlet into which the plug body of the attachment plug is to be inserted, and an engagement portion formed all over an inner circumference of the plug insertion inlet of the socket through which the attachment plug is to be inserted so that the engagement portion locks the lock portions in the socket through elastic displacement of the lock portions when the attachment plug is inserted into the jack, the engagement portion being formed so as to fold an end portion of the socket at the plug insertion inlet side back into the socket, wherein rear end surfaces of the lock portions of the attachment plug are formed perpendicular to an axial direction of the attachment plug so that the perpendicular rear end surfaces abut against a folded end portion of the engagement portion of the socket of the jack which is folded back deeper into the socket, so that the lock portions are locked by the engagement portion.

3. The connector of claim 2, wherein the rear end surfaces of the lock portions of the attachment plug abuts against an end surface of the folded end portion of the engagement portion of the socket of the jack so that the lock portions are locked by the engagement portion.

4. The connector of claim 3, wherein the inner circumferential surface of the engagement portion of the socket of the jack is formed to be a slope having a diameter which is reduced gradually from the plug insertion inlet of the socket toward a deeper portion thereof.

5. The connector of claim 1, further comprising a spring member provided in the plug body of the attachment plug so that the spring member presses against the inner circumferential surface of the engagement portion of the socket of the jack.

6. The connector of claim 1, wherein the engagement portion is formed so as to make locking of the lock portions on the engagement portion act in a direction such that reaction force of the locking does not cause the elastic displacement of the lock portions.

* * * * *